US006994025B1

(12) United States Patent
Faber

(10) Patent No.: US 6,994,025 B1
(45) Date of Patent: Feb. 7, 2006

(54) SELF-INKING HAND STAMP

(75) Inventor: Ernst Faber, Wels (AT)

(73) Assignee: Colop Stempelerzeugung Skopek GmbH & Co.KG, Wels (AT)

( * ) Notice: Subject to any disclaimer, the term of this patent is extended or adjusted under 35 U.S.C. 154(b) by 0 days.

(21) Appl. No.: 09/913,808

(22) PCT Filed: Feb. 8, 2000

(86) PCT No.: PCT/AT00/00029

§ 371 (c)(1),
(2), (4) Date: Dec. 20, 2001

(87) PCT Pub. No.: WO00/48843

PCT Pub. Date: Aug. 24, 2000

(30) Foreign Application Priority Data

Feb. 18, 1999 (AT) ..... 105/99 U

(51) Int. Cl.
*B41K 1/42* (2006.01)

(52) U.S. Cl. ..... 101/104; 101/334; 101/405

(58) Field of Classification Search ..... 101/103, 101/104, 108, 333, 334, 405
See application file for complete search history.

(56) References Cited

U.S. PATENT DOCUMENTS

| | | | | |
|---|---|---|---|---|
| 1,879,387 A | * | 9/1932 | Melind | 40/328 |
| 1,909,257 A | * | 5/1933 | Evans | 40/328 |
| 4,432,281 A | | 2/1984 | Wall et al. | 101/334 |
| 4,579,057 A | * | 4/1986 | Hewitt et al. | 101/368 |
| 4,823,696 A | | 4/1989 | Skopek | 101/334 |
| 5,048,414 A | * | 9/1991 | Hoshino | 101/93.18 |
| 5,577,444 A | * | 11/1996 | Toyama | 101/379 |
| 5,623,875 A | * | 4/1997 | Perets | 101/334 |
| 5,740,737 A | * | 4/1998 | Polak et al. | 101/334 |
| 5,826,506 A | * | 10/1998 | Lin | 101/327 |
| 5,855,170 A | * | 1/1999 | Shih | 101/327 |
| 6,058,840 A | * | 5/2000 | Poplawski et al. | 101/405 |

FOREIGN PATENT DOCUMENTS

| | | |
|---|---|---|
| AT | 380 836 | 7/1986 |
| AT | 1271 U | 2/1997 |
| DE | 11 36 720 | 9/1962 |
| EP | 0 475 061 | 3/1992 |
| WO | WO01/83227 A1 * | 11/2001 |

* cited by examiner

*Primary Examiner*—Ren Yan
*Assistant Examiner*—Jill E. Culler
(74) *Attorney, Agent, or Firm*—Collard & Roe, P.C.

(57) ABSTRACT

A self-inking hand stamp (1) with upper impact inking, comprising a stamp housing (2) in which a stamp aggregate (3) is arranged that is capable of moving from an inking position on an ink pad (4) into a stamping position, with an actuating frame (8) as well as a reversing mechanism being associated with the stamp aggregate for said purpose, whereby the actuating frame (8) is mounted like a cap on the top part of the stamp housing (2), and comprises two legs (9, 10) for actuating the stamp aggregate (3), said legs resting against the stamp housing (2), and can be depressed relative to the stamp housing (2) against spring force, and is provided with a receiving recess (17) for accommodating an information sheet (18), with a transparent cover (24) being associated with the receiving recess (17). The receiving recess (17) extends from the top side (16) of the actuating frame (8) to the broad sides (19, 20) of the frame, and the transparent cover (24) is correspondingly curved from the top side to the broad side and embodied in the form of one single piece.

6 Claims, 2 Drawing Sheets

SELF-INKING HAND STAMP

CROSS REFERENCE TO RELATED APPLICATIONS

Applicant claims priority under 35 U.S.C. §119 of Austrian Application No. GM 105/99, filed on 18 Feb. 1999. Applicant also claims priority under 35 U.S.C. §365 of PCT/AT00/00029, filed on 8 Feb. 2000. The international application under PCT article 21(2) was not published in English.

BACKGROUND OF INVENTION

1. Field of Invention

The invention relates to a self-inking hand stamp with upper impact inking comprising a stamp housing in which a stamp aggregate is arranged that is capable of moving from an inking position on an ink pad to a stamping position, and an actuating frame with a reversing mechanism associated with the stamp aggregate for this purpose. The actuating frame comprised of a top side, two broad sides opposite each other, as well as two narrow sides opposite each other, is mounted on the upper part of the stamp housing in the form of a cap. The actuating frame comprises two legs resting laterally on the stamp housing for actuating the stamp aggregate. It can be pressed down in relation to the stamp housing against a spring force and has a receiving recess located at its top side for accommodating an information sheet, with a transparent cover being detachably mounted on the receiving recess.

2. Description of the Prior Art

Such self-inking hand stamps offer the advantage of a compact and handy construction as compared to stamps having an upwardly projecting handle mounted on the top side of the actuating frame—compare, for example U.S. Pat. No. 4,432,281 A or AT 1271 U, with U.S. Pat. No. 4,823,696 A.

It is also common practice in such self-inking hand stamps with a cap-like actuating frame to accommodate an information sheet on the top side of the cap in a sight window that displays the respective stamp imprint to be produced, in order to inform the user about the respective stamp imprint when using a multitude of stamps. Provision is usually made for a transparent cover with a more or less plane surface, which is snapped on to the actuating frame above the recess for receiving the information sheet. However, users frequently require additional information, such as company information, information relating to various departments within a company, advertising data and similar information. For this purpose, actuating frames in different colors conforming to different departments in a company, for example such as hand stamps with plastic actuating frames dyed in black, blue and red, have been provided. In addition, it has become customary to glue labels to the broad sides of the upper components of the actuating frame such as, for example, labels containing the information "department X". On the other hand, it has been proposed also to provide receiving recesses for accommodating labels on the two broad sides of the actuating frame instead of on the top side in order to accommodate information labels in such recesses—compare AT 380 836 B. However, these various proposals all have been found unsatisfactory in practice but they were accepted because only these designs were viewed as useful in self-inking hand stamps in which the stamp housing resiliently supports the cap-shaped actuating frame, in spite of the fact that it has been known from DE 1 136 720 C to place a label on the head of the handle of a hand stamp that extended from the top side to the narrow sides and possibly also up to the broad sides of the head of the grip, with a cap attached to the top that enclosed the head of the handle on all sides. However, this hand stamp had no self-inking system, so that no components had to be accommodated in the interior of the handle. Furthermore, no provision was made for receiving recesses on the head of the handle for accommodating the labels, which were simply inserted under the generally square cap. Such a cap poses only few problems with a hand stamp without a self-inking system in spite of the instability it causes when stamp imprints are produced because no moving components are present; however, in connection with self-inking stamps such a cap may lead to an inadequate stamp imprint that even may be smudgy under certain circumstances.

SUMMARY OF THE INVENTION

Therefore, the problem of the invention was to provide a self-inking hand stamp of the type specified above that offers in an integrated form the possibility to easily and safely accommodate additional information apart from a sample of the respective stamp imprint, without increasing the cost of the manufacture and assembly of the components of the stamp, and without impairing the production of stamp imprints.

The self-inking hand stamp of the type specified above solves this problem with a receiving recess which continuously extends with lateral limitation at the narrow sides from the top side of the actuating frame to at least one broad side of the actuating frame, and a one-piece transparent cover which is curved accordingly, arching from the top side to at least one broad side.

Owing to the fact that the receiving recess extends not only over the top side but also over at least one broad side of the top part of the actuating frame, it is possible to accommodate in addition to the information on the top side also information on the at least one broad side. Such accommodation is preferably realized with a suitably sized information sheet inserted in the receiving recess that extends both across the top side and also across the area of the receiving recess located on the broad side of the actuating frame, displaying the stamp imprint, for example on the top side, whereas information about the company or company department, advertising information, etc. is contained within the area of the broad side. Such an arrangement has no adverse effects with respect to the manufacture of the hand stamp because the receiving recess can be formed without problems in the course of manufacture of the actuating frame, for example from plastic by injection molding. It is possible in a similar manner to produce the transparent cover in a curved instead of the more or less plane form, particularly by injection molding as well, using a transparent plastic. It is possible also to fix the cover in the usual manner by locking or snapping it on. It is accordingly possible to keep the manufacture of the components of the hand stamp and the assembly of the latter within the framework used heretofore. In particular, it continues to be possible without problems to mount one or more springs between the top side of the stamp housing and the inner side of the actuating frame below the receiving recess. The strength of the actuating frame is not impaired by the recess that continues to extend over at least one broad side because the edges of the recess located adjacent to the narrow sides act as reinforcing ribs. During stamping, this supports an adequate transmission force especially to said area of the narrow side, where the legs of the actuating frame establish the connection to the stamp aggregate.

To obtain an information surface area that is as large as possible, as well as a symmetrical design that facilitates the manufacture, it is particularly advantageous if the receiving recess extends with a generally U-shaped cross section to both broad sides of the actuating frame, and if the transparent cover has a substantially U-shaped, curved cross section.

For mounting the transparent cover by simply snapping or locking it on, the transparent cover advantageously cover has locking projections located on its inner surface along the edge, for locking the cover in locking recesses located on the edge of the receiving recess. Provision is usefully made for at least one locking projection on the at least one broad side, and for a locking projection on the opposite edge on the top side, but preferably on the other broad side if the receiving recess extends toward both broad sides. The cover is shaped in a suitable form or with initial elastic tension, so that it is attached to the receiving recess and snapped on with elastic deformation. For safely securing the transparent, curved cover on the actuating frame, it is useful in this connection if a strip-like, center locking projection is molded onto each of the edges of the transparent cover, with a corresponding, oblong locking window located on the respective edge of the receiving recess being associated with such a locking projection.

Furthermore, it is advantageous for simplified mounting of the information sheet if the locking projections on the inner surface of the transparent cover form at the same time a holding means for fixing the information sheet. In such an embodiment, the information sheet is first inserted in the cover, curving accordingly, and the cover together with the information sheet is subsequently snapped onto the actuating frame.

In order to obtain a defined space for receiving the information sheet, or an arrangement of the transparent cover with a spacing from the bottom of the receiving recess, and to nonetheless permit compact and fixed mounting of the cover, it is advantageous also if the receiving recess has at least one support shoulder located on the edge side for supporting the edge of the transparent cover. It was found particularly useful in this connection if the receiving recess within the area of the edge of the broad side has a shoulder that extends adjacent to the narrow sides up to the top side, with its height close to zero.

To assure the snap-on attachment of the transparent cover and an elastic deformation of the cover without the risk of breaking it, and in order to obtain a relatively plane substrate in the interest of good readability of the information sheet, such substrate being shaped by the bottom of the receiving recess, it is advantageous if the top side of the receiving recess, as well as the area of the broad sides, is only slightly curved at most, as compared to the arched transparent cover.

Finally, for the manufacture and as also for the deformation, it is advantageous if the transparent cover is curved both in the transverse and longitudinal directions.

BRIEF DESCRIPTION OF THE DRAWINGS

The invention is explained in greater detail in the following in conjunction with the preferred embodiments shown in the drawing, without being limited to such exemplified embodiments. In the drawing.

DETAILED DESCRIPTION OF THE PREFERRED EMBODIMENTS

Figure 2:
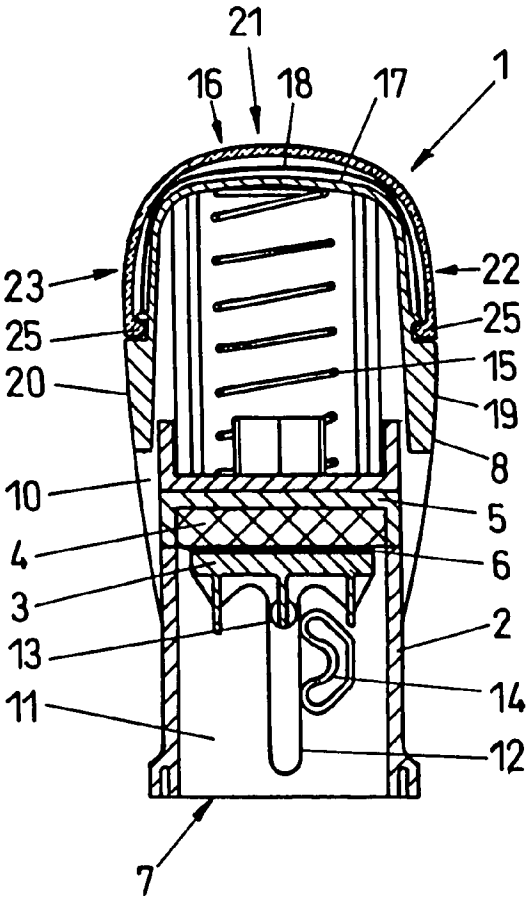
FIG. 2 shows a vertical section through said hand stamp according to line II—II in FIG. 1.
Figure 1:
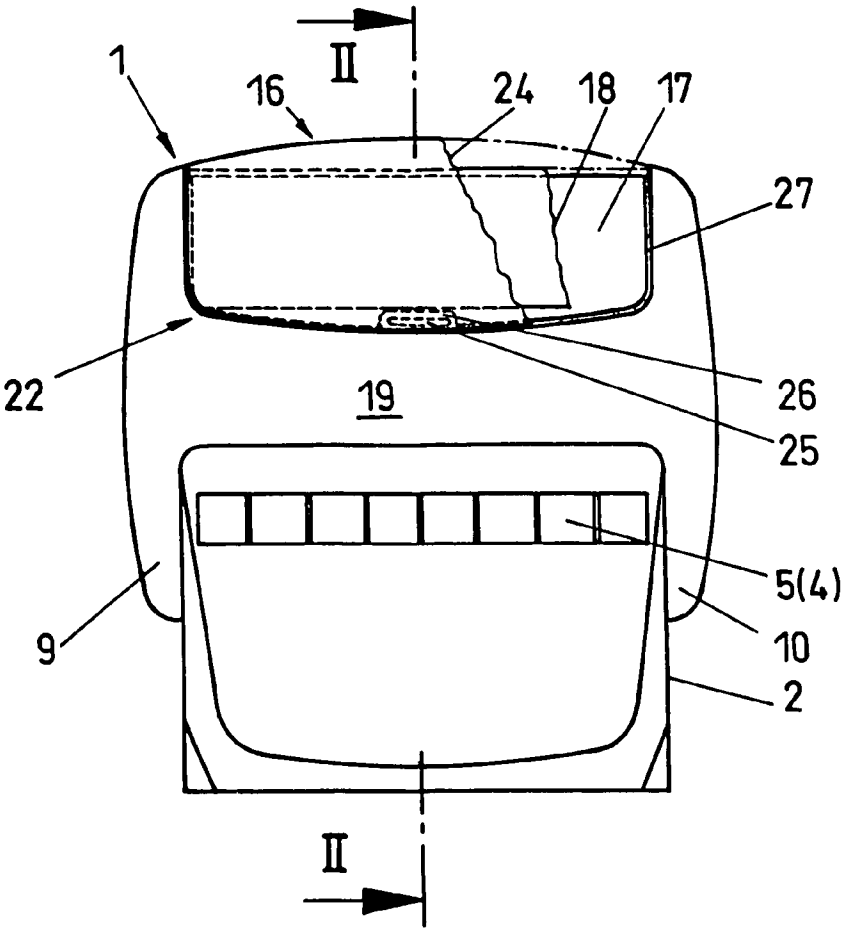
FIG. 1 is a schematic view of a self-inking hand stamp comprising an actuating frame mounted on the stamp housing in the form of a cap.

FIGS. 1 and 2 show a self-inking hand stamp 1 with upper impact inking, which comprises a stamp housing 2, in which a stamp aggregate 3 is movably arranged in a conventional manner. Said stamp aggregate 3 is shown in FIG. 2 in the upper normal or inking position, resting on an ink pad 4 in a pad drawer 5 pushed into a receptacle in the stamp housing 2. From said upper position, the stamp aggregate 3 can be moved down and swivelled at the same time by 180°, so that it is capable of producing an imprint on a document with its printing side 6 through the lower opening 7 of the stamp housing 2. For such actuation of the stamp, provision is made for an actuating frame 8 mounted on the stamp housing 2 in the manner of a cap. The actuating frame is comprised of the two legs 9, 10 (see FIG. 1) that slide along the two narrow side walls 11 (FIG. 2) of the stamp housing and are connected with the stamp aggregate 3 by pins 13 extending through a vertical guide slot 12. For reversing the stamp aggregate 3, suitable control cams 14 on the inner side of the side walls 11 cooperate with corresponding stop means provided on the stamp aggregate 3. Such a reversing mechanism (12, 13, 14) is known per se.

Within the cap-like top part of the actuating frame 8, a pressure spring 15 is arranged between the stamp housing 2 and the actuating frame 8. Said pressure spring forces the actuating frame 8 into the upper normal or inking position shown. The pressure spring 15 is supported on the top side of the stamp housing 2, on the one hand, as well as on the inner surface of the actuating frame 8 on its top side 16, on the other hand.

On top side 16 of the actuating frame 8, a receiving recess 17 for accommodating an information sheet 18 is molded on the outer side. Receiving recess 17 extends continuously with a U-shaped cross section over both broad sides 19, 20 of the actuating frame 8, up to about half of the height of the cap-shaped top part, and is delimited there as well as at the narrow sides of the actuating frame 8 by an edge. Substantially three coherent information surfaces or information recesses are obtained in this way, namely a top information surface 21 as well as the two information surfaces 22 and 23 on the broad sides. For covering the receiving recess 17 or the information sheet 18 inserted therein, provision is made for a dish-shaped transparent cover 24, which has a substantially U-shaped cross section, see FIGS. 3 and 4. Said cover is simply snapped onto the actuating frame 8.

Figure 3:
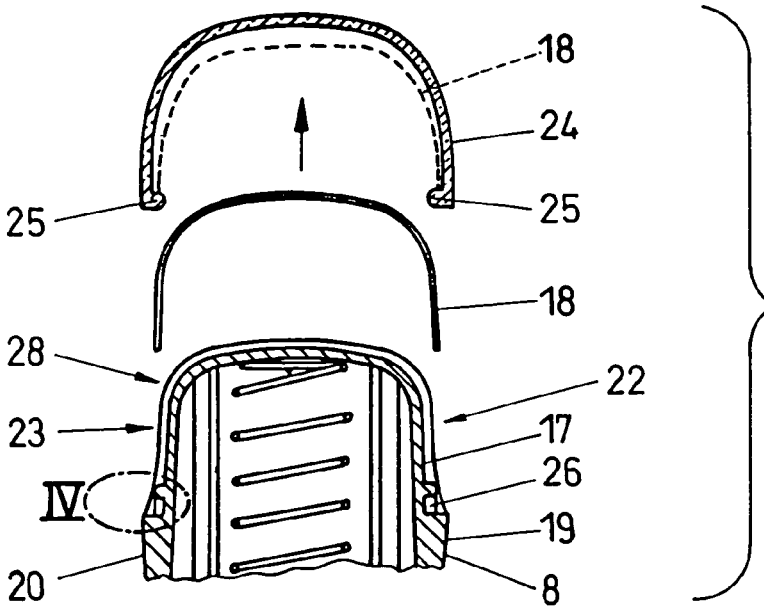
FIG. 3 shows a corresponding vertical section through the upper part of said hand stamp, shown, however, by an exploded representation of the transparent cover, an information sheet, and the actuating frame with the receiving recess provided on the latter for receiving the information sheet.
Figure 4:
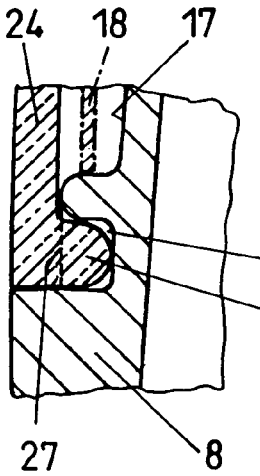
FIG. 4 shows on a larger scale a sectional view of the detail IV of FIG. 3 within the area where the cover is locked on the actuating frame.
Figure 5:
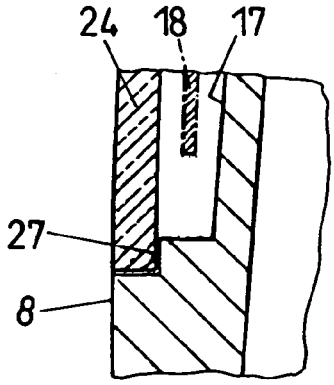
FIG. 5 shows a comparative sectional detailed view of an area outside the locking site for illustrating a shoulder-like support protrusion for supporting the transparent cover.

For said purpose, the locking projections 25 are molded in the center of the edge of the cover 24 on the inner side, and engage corresponding locking recesses 26 located on the edge of the receiving recess 17 on broad sides 19, 20 of the actuating frame 8. In the embodiment according to FIGS. 1 to 5, each locking projection 25—and correspondingly the window-like locking recess 26—is oblong, as shown in FIG. 1, and said locking elements 25, 26 are arranged in the center of the broad sides 19 and 20. The locking windows 26 adjoin the shoulders 27 on the recess edge, as can be seen in FIG. 1 for the one broad side 19, and in FIG. 5, which shows a section similar to FIG. 4, but in a site next to the locking elements 25, 26, and whose height adjacent to the narrow sides of the frame comes close to zero toward the top side 16. Furthermore, an information sheet 18 inserted in the receiving recess 17, as is shown in FIGS. 4 and 5 by the dash-dotted line. For mounting it with the cover 24 removed, information sheet 18 is first inserted in cover 24 on the inside—see the arrow and the dashed representation of the information sheet 18 within the cover 24 in FIG. 3, the locking projections 25 also serving as means for holding the information sheet 18. Subsequently, the cover 24 together with the information sheet 18 is placed on top of the actuating frame 8 and the locking projections 25 snap into the locking windows 26. This causes the information sheet 18 to be tightly pressed against the bottom of the receiving recess 17 which, as shown in FIG. 3, is flatter in the two broad-side information areas 22, 23 as well as in the information area 21 at the top side than cover 24 having a cross section with a more pronounced curvature.

The cover 24 may have a convex curvature also in the longitudinal direction (see FIG. 1) in order to permit it to adapt itself to the contour of the actuating frame 8 and to permit it to snap in more forcefully under elastic initial tension. Furthermore, as shown in FIG. 2, the two broad-side legs of the dish-shaped cover 24 may be shaped slightly converging downwards, and the cross section of the cover 24 may be approximately semi-circular. As opposed thereto, the receiving recess 17 has an almost rectangular shape, except for the rounded corners in the area of transition from the broad sides 19 and 20 to the top side 16, where the cover 24 comes close to the bottom of the receiving recess 17 on the inner side—see FIG. 2.

Figure 6:
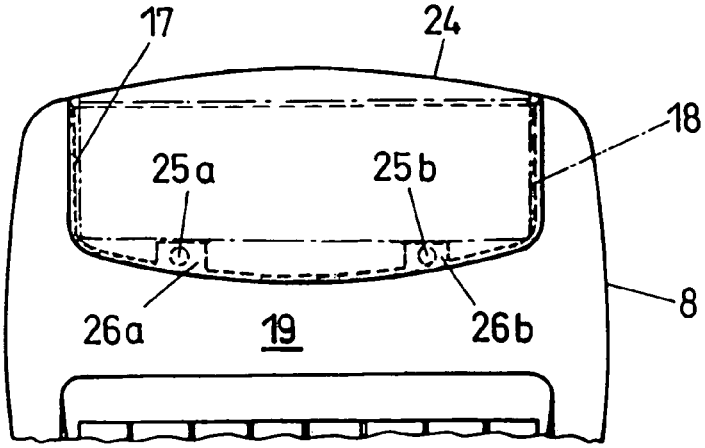
FIG. 6 shows a partial view similar to FIG. 1 of the upper part of a modified self-inking hand stamp.

FIG. 6 shows a modified embodiment of a self-inking hand stamp in that transparent cover 24 is snapped on each broad side 19 of the actuating frame 8 with the help of two locking projections 25*a*, 25*b* that are arranged close to the side, said locking projections engaging the corresponding locking recesses 26*a*, 26*b* located on the edge of the receiving recess 17. In the present case, too, the locking projections 25*a*, 25*b* can be used as means for mounting the information sheet 18, as explained above.

Another possibility for locking the cover 24 on the edge of the receiving recess 17 would be to provide an at least partially undercut edge of the receiving recess 17 or cover 24. However, it has been found that this makes it relatively difficult to remove the cover 24 from the actuating frame 8, so that the embodiment with the locking projections 25 and locking windows 26 described above was found to be more favorable. Another possible modification of the described self-inking hand stamp consists of providing receiving recess 17 on only one broad side, for example 19, as well as on the top side 16, while the fastening point for securing the cover 24 on the broad side 20 of actuating frame 8 would be shifted upwards into the corner area, viewed in the cross section, as schematically indicated in FIG. 3 at 28. Viewed in the cross section, an approximate L-shape would accordingly be obtained for the receiving recess 17 and the cover 24 instead of the U-shape.

What is claimed is:

1. A self-inking hand stamp with upper impact inking, which comprises (a) a stamp housing, (b) a stamp aggregate arranged in the stamp housing, the stamp aggregate being capable of moving from an inking position on an ink pad into a stamping position, (c) an actuating frame incorporating a reversing mechanism, which is mounted in form of a cap on top of the stamp housing and can be depressed relative thereto against a spring force for moving the stamp aggregate from the inking position into the stamping position, the actuating frame comprising (1) two broad sides opposite each other, (2) two narrow sides opposite each other, the narrow sides extending into legs resting laterally on the stamp housing, and (3) a top side having a receiving recess for accommodating an information sheet, the receiving recess extending continually from the top side to at least one of the broad sides and being delimited by edges before it reaches the narrow sides, and (d) a one-piece transparent cover detachably mounted over the receiving recess, the cover being curved to conform to the receiving recess, and comprising (1) locking projections inwardly extending from the edges thereof for snapping into locking recesses in the edges of the receiving recess on the broad sides, the locking projections also forming means for holding the information sheet in a curved shape conforming to the curved transparent cover on an inside thereof when the transparent cover is detached from the top side of the actuating frame.

2. The self-inking hand stamp of claim 1, wherein the receiving recess is substantially U-shaped and extends from the top side to both broad sides of the actuating frame, and the transparent cover is conformingly U-shaped.

3. The self-inking hand stamp of claim 1, wherein the locking projections are strips molded on the edges of the transparent cover, and the locking recesses are conforming locking windows.

4. The self-inking hand stamp of claim 1, wherein the receiving recess has a support shoulder at at least one of the edges for supporting an edge of the transparent cover.

5. The self-inking hand stamp of claim 1, wherein the receiving recess on the top side and the at least one broad side of the actuating frame is at most less curved than the curved transparent cover.

6. The self-inking hand stamp of claim 1, wherein the transparent cover is curved in transverse and longitudinal directions.

* * * * *